United States Patent [19]

Abu-Shumays et al.

[11] Patent Number: 4,706,956

[45] Date of Patent: Nov. 17, 1987

[54] REGULAR POLYHEDRON PUZZLES

[76] Inventors: Ibrahim K. Abu-Shumays; Mary D. Abu-Shumays, both of 1248 Varner Rd., Pittsburgh, Pa. 15227

[21] Appl. No.: 922,479

[22] Filed: Oct. 23, 1986

Related U.S. Application Data

[63] Continuation-in-part of Ser. No. 839,368, Mar. 14, 1986, Pat. No. 4,674,750, which is a continuation-in-part of Ser. No. 687,141, Dec. 28, 1984, abandoned, which is a continuation-in-part of Ser. No. 604,941, Apr. 27, 1984, abandoned, which is a continuation-in-part of Ser. No. 394,869, Jul. 2, 1982, Pat. No. 4,593,907.

[51] Int. Cl.[4] ..... A63F 9/08

[52] U.S. Cl. ..... 273/153 S

[58] Field of Search ..... 273/153 S

[56] References Cited

U.S. PATENT DOCUMENTS

| | | | |
|---|---|---|---|
| 4,451,039 | 5/1984 | Hewlett, Jr. | 273/153 S |
| 4,453,715 | 6/1984 | Halpern | 273/153 S |
| 4,474,377 | 10/1984 | Ashley | 273/153 S |
| 4,558,866 | 12/1985 | Alford | 273/153 S |

*Primary Examiner*—Anton O. Oechsle

*Attorney, Agent, or Firm*—William J. Ruano

[57] ABSTRACT

This invention introduces several variations of Regular Polyhedron Puzzles which are improvements, generalizations and extensions to "Rubik's" Cube, "Pyraminx" tetrahedron and the class of puzzles given in the reference cited. The preferred embodiments include octahedron and icosahedron cubic puzzles. The distinguishing features and examples of the puzzles are briefly described. Each of the puzzles is comprised of component pieces which are joined and held together by an appropriate means to form a desired overall regular polyhedron shape having at least eight (8) plane faces. The external surfaces of each puzzle are to be assigned a unique combination of colors or pictures. The mechanism of motion makes it possible to rotate the individual component pieces of a puzzle in groups around lines joining the puzzle center and the puzzle vertices. Various possible rotations (twists and turns) result in mixing up the surface configurations. The object and the challenge is to restore the various surfaces of a puzzle into their original form, or to perform twists and turns that would result in alternate interesting designs.

10 Claims, 8 Drawing Figures

REGULAR POLYHEDRON PUZZLES

This is a continuation in part of application Ser. No. 839,368, filed Mar. 14, 1986, now U.S. Pat. No. 4,674,750 which in turn was a continuation in part of application Ser. No. 687,141, filed Dec. 28, 1984, involuntarily abandoned, which in turn was a continuation in part of application Ser. No. 604,941, filed Apr. 27, 1984, abandoned, which in turn was a continuation in part of application Ser. No. 394,869, filed July 2, 1982, now U.S. Pat. No. 4,593,907.

BACKGROUND OF THE INVENTION

1. Field of the Invention

This invention relates to cubic class puzzles having an overall shape of a regular polyhedron with eight or more plane faces. Each puzzle is comprised of various pieces which rotate in groups around lines joining the puzzle center and the puzzle vertices. Admissible rotations alter the surface configurations. The object and the challenge is to perform twists and turns aimed at restoring the surfaces to their original configuration or to other interesting designs.

2. Description of the Prior Art

This invention generalizes the "Rubik's" Cube (Rubik's Cube is a registered trademark of Ideal Toy Corporation), "Pyraminx" tetrahedron ("Pyraminx" is a registered trademark of Tomy Corporation), and similar cubic puzzles. This invention introduces alternative puzzles having regular polyhedron shapes with eight or more plane faces, and introduces a new range of challenges, and ease of assembly. The following comments distinguish the subject puzzles from the prior art:

The Rubik's Cubes and the polyhedron puzzles considered by Halpern in U.S. Pat. No. 4,453,715, have each of their pivots or axes of rotation (which emanate from the puzzles' core central parts) pointing towards or being attached to centers or center pieces of an external plane face; consequently no corner piece of these polyhedron puzzles is joined to an axis of rotation and is restricted to actually and physically rotate in place relative to the corresponding core central part. Correspondingly, each of the planes of rotation of the puzzles of U.S. Pat. No. 4,453,715, and of the Rubik's Cubes, is always parallel to some external plane face of the corresponding polyhedrons. Each group of external pieces of these puzzles which share a complete external plane face parallel to a plane of rotation can be rotated together as a group relative to the corresponding core central part. The comments in this paragraph also apply to several other available puzzles of the prior art. In contrast, in all the species of the present invention, proper rotations of groups of regular polyhderon puzzle component pieces are always around straight lines which join a vertex (a corner point) and the center of the corresponding overall polyhderon shape. Consequently each plane of rotation in the subject puzzles of this invention must be orthogonal (perpendicular) to a straight line joining a vertex and the geometric center of the overall shape.

Halpern, in his U.S. Pat. No. 4,453,715, has been allowed a generic claim, his claim 1. The external forms of his puzzles are restricted to polyhedrons which are 3-valent (for each vertex there are exactly 3 faces) and which are convex. Furthermore, his claim 1 specifically requires (Column 10, lines 23–25) "a plurality of face components, each of said face components being rotatably mounted on a different one of said mounting means." The class of puzzles considered by Halpern in U.S. Pat. No. 4,453,715, specifically excludes the classes of puzzles introduced here. Here there is a plurality of corner component pieces, each of said corner component pieces being rotatably mounted on a different one of the mounting means or rod (pivots) of rotation.

SUMMARY OF THE INVENTION

This invention introduces alternative puzzles having regular polyhedron shapes with eight or more plane faces. In all the species of the present invention, proper rotations of puzzle component pieces are always around straight lines which join a vertex (a corner point) and the center of the corresponding regular polyhedron. Consequently each plane of rotation in the subject puzzles of this invention must be orthogonal (perpendicular) to a straight line joining a vertex and the geometric center of the overall shape.

The puzzles introduced here can be visualized as follows. Consider any regular polyhedron solid with N vertices and eight (8) or more plane faces. Let L be the length of any edge joining two adjacent vertices of the regular polyhedron solid. Associated with each vertex one plane of rotation orthogonal (perpendicular) to the stright line which joins that vertex to the geometric center of the regular polyhedron solid. The plane of rotation associated with a vertex must be situated such as to intersect each edge of the solid polyhedron emanation from that vertex at a distance D away from that vertex. The distance D must be larger than L/2, half the length L of an edge, and smaller than or equal to L. The actual preferred range of the ratios D/L differ for the different regular polyhdron shapes of the preferred embodiments considered here. The distance D is allowed to be equal to L only if the plane of rotation associated with each vertex does not pass through the geometric center of the regular polyhedron solid, or is not co-planar with an edge of this polyhedron. All the N planes of rotation must be equidistant from the geometric center of the regular polyhedron solid.

Now the regular polyhedron solid is cut along each of the planes of rotation. The resulting component pieces of the solid polyhedron will always include: (i) corner component pieces, (ii) center edge or edge component pieces each having two exposed plane faces, (iii) a core center piece. The core center piece is to be replaced by either (a) an inner sphere with origin the center of the regular polyhedron and with a surface tangent to all the planes of rotation, or (b) an axial rod (pivot) system with each rod orthogonal to a plane of rotation and extending between that plane of rotation and the center of the regular polyhedron; the rods are fixed relative to each other, or (c) an internal concentric regular polyhedron which extends between the planes of rotation and which has plane faces parallel to the plane faces of the original regular polyhedron solid. Connecting means including knobs and grooves are intorduced such that the component pieces between any vertex of the original regular polyhedron and the plane of rotation associated with that vertex can rotate as a group around the straight line joining that vertex and the geometric center of the puzzle.

All the puzzles introduced here are of the cubic class whereby the surface configurations can be altered by twists and turns and the challenge is to restore the surface to the original configuration or to other interesting designs. The preferred embodiments of this invention are: two octahedron puzzles, and an icosahedron puzzle.

No mention is made here of the material to construct these puzzles. It may be plastic, wood, metal, etc., or a combination. The component pieces may be solid or may have hollow insides. Ball bearings or combinations of hemi-spherical surface knobs and grooves to enhance the quality of motion and stabilize the rest positions are desirable as is now standard. Since these items are not new, they are not discussed in details below. Exact dimensions are not mentioned, since this is a relative matter and can be varied. Relative dimensions are provided when essential.

BRIEF DESCRIPTION OF THE DRAWINGS

The following drawings illustrate examples of the basic shapes which are the subject of this invention.

FIG. 1 is a perspective view of a Rubik's type octahedron and its component pieces.

FIG. 2 is a perspective view of a Pyraminx type octahedron and of its component pieces. FIGS. 2*b–d* show the central core part to be respectively a sphere 4, a rod axis system 5, or an internal Octahedron 6 having the same geometric center as that of the overall puzzle and having faces parallel to faces of the external octahedron structure of the puzzle.

FIG. 3*a* is a perspective view showing 10 of the 20 equilateral triangular plane faces of the puzzle and showing by double lines basic subdivisions of component pieces and borders of planes of rotation. FIG. 3*a* shows examples X—X and Y—Y of typical planes of rotation associated with vertices of the icosahedron. The component pieces above plane X—X or below plane Y—Y can rotate jointly, as can the typical corner component piece 1 and its five adjacent edge pieces 2, 3, 4, 5, and 6, (edge piece 6 is not visible in the view of the puzzle shown). FIG. 3*b* also shows a perspective view of a typical corner component piece 1 which, in the assembled position, is held to the core central part by the screw pivot shown by the expanded view, and is retricted to rotate in place. This figure also shows a typical edge component piece 4 (not to scale) which is held in place by a knob which fits in grooves. Each edge component piece migrates from edge to edge as a result of twists and turns.

DESCRIPTION OF THE PREFERRED EMBODIMENTS

Figure 1A:
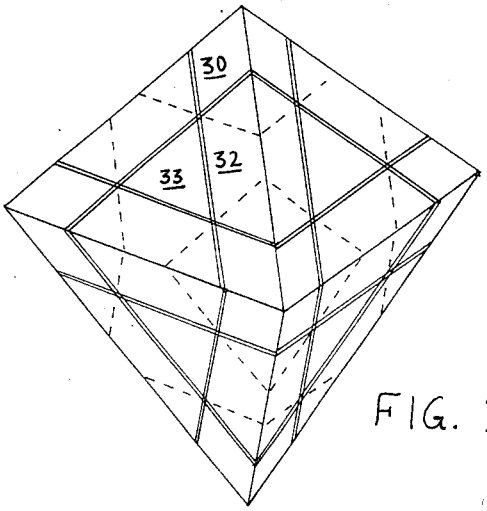
FIG. 1*a* is a perspective view of the overall shape showing with double lines basic subdivisions of corner 30, edge 32, and face center 33 component pieces, and showing possible additional subdivisions along dashed lines.

Other objects and advantages of the invention will become more apparent from a study of the summary of the invention, the description of the drawings given above and from the additional description given below. For convenience, a double line notation is adopted in the drawings to indicate separation of adjoining component pieces for the preferred embodiments of each species, and also to indicate borders of planes of rotation of component pieces.

All of the puzzles introduced here have regular polyhedron shapes with N vertices and N planes of rotation associated with these vertices. Each regular polyhedron shape considered has eight (8) or more plane faces. A plane of rotation associated with a vertex (a) is orthogonal (perpendicular) to the straight line joiing that vertex to the geometric center of the puzzle, and (b) intersects each of the edges of the puzzle which emanates from that vertex at a fixed distance D from that vertex. The ration D/L, where L is the length of a typical edge of the regular polyhedron shape under consideration, must be appropriately chosen (D/L larger than half but less than or equal to one) for each of the regular polyhedron shapes. D must not equal L if each resulting plane of rotation passes through the geometric center of the puzzle or is co-planar with an external edge of the puzzle. The component pieces of the puzzle between a plane of rotation and its associated vertex can rotate together as a group around the straight line joining that associated vertex to the center of the puzzle. Ball bearings or combinations of small hemi-spherical knobs and grooves betwen puzzle component pieces are desirable in order to stabilize the rest positions.

Additional information related to the present invention is now associated with the regular shapes of the following preferred embodiments: (A) Rubik's Type Octahedron, (B) Pyraminx Type Octahedron, and (C) Icosahedron.

(A) and (B), Octahedron Puzzles

The distinct octahedron puzzles introduced here share the same regular octahedron shape with eight equilateral triangular faces. They are distinguished by the distances of their planes of rotation from their respective geometric centers. The first of these puzzles is shown in FIGS. 1*a,b*. This puzzle, in its preferred embodiment has:

(a) six corner pieces 30, each with four visible diamond-shaped faces. Each of these pieces 30 sits and revolves freely around an axis of rotation 31 emanating from the center of the puzzle (See FIG. 2*c* for a possible means to make this possible), (b) Eight face center pieces 33, each with one visible equilateral triangle face, and (c) Twelve edge pieces 32, each with two visible trapezoidal-shaped faces.

Figure 1B:
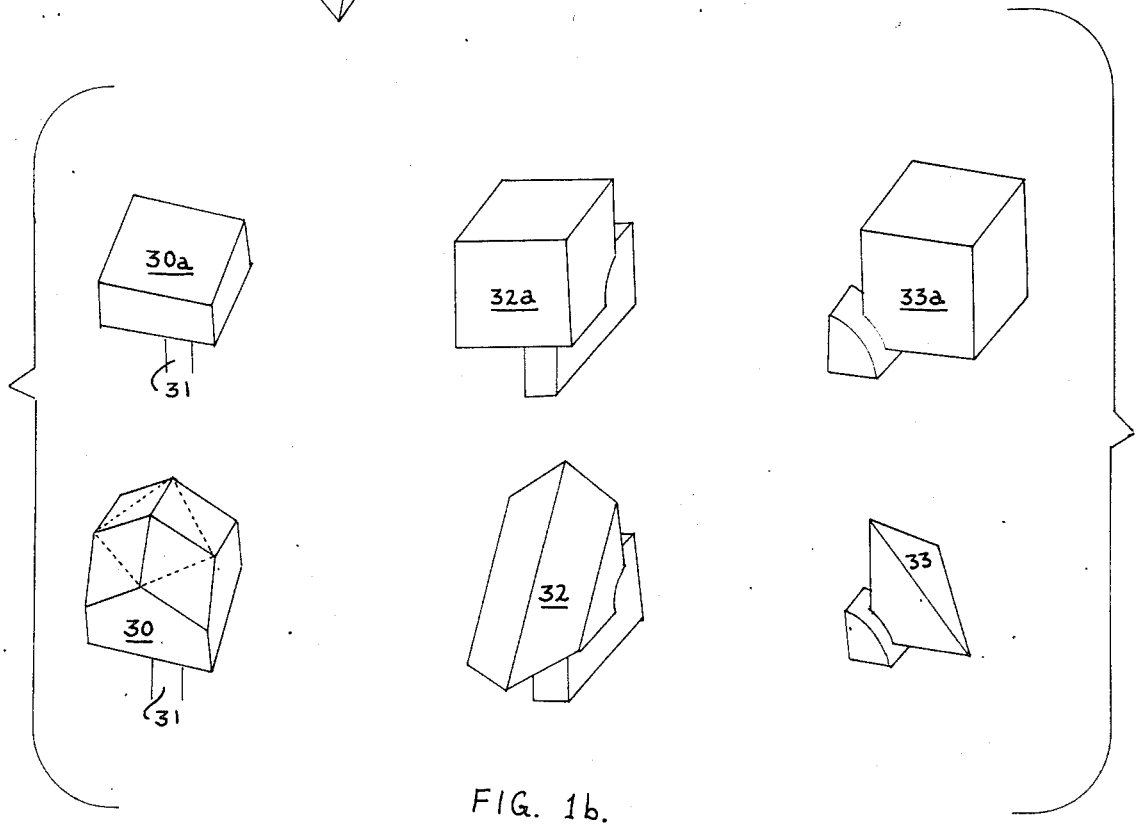
FIG. 1*b* shows on the top row typical face center 30*a* piece, edge 32*a* piece, and corner 33*a* piece of Rubik's Cube, and shows on the bottom row typically corresponding corner 30, edge 32, and face center 33 pieces of the octahedron puzzle.

In brief, this puzzle has a total of 26 visible pieces. This puzzle can be formed directly from the Rubik's Cube by modifying the external shapes of the pieces of the cube as is shown in FIG. 1*b*. Here the corner pieces 30, the edge pieces 32 and the face center pieces 33 of this octahedron puzzle correspond respectively to the face center pieces 30*a*, the edge pieces 32*a* and the corner pieces 33*a* of Rubik's Cube.

A more challenging puzzle results if each edge piece is cut into three parts along the dashed lines shown in FIG. 1*a*, modifying the internal structure of the component pieces by appropriately modifying their knobs and grooves. Furthermore, the relative size of the center face triangular pieces can be modified for cosmetic appeal.

Again the size of the various pieces of the subject octahedorn puzzle may be varied as a result of different choices of lcoations of planes of rotation. For example, for the choice of planes of rotation such that each plane of rotation associated with a vertex passes through the geometric centers of the triangular faces which have that vertex in common, the face center pieces 33 of FIG. 1*a* disappear altogether. The result is the preferred embodiment which has the shape shown in FIGS. 2*a–c*. In this case, the faces of the edge pieces 2 become equilateral triangles, rather than trapezoids (see FIG. 1 edge pieces 32). These edge pieces can be held in place in a manner analogous to that adopted for the Pyraminz tetrahedon.

Figure 2A:
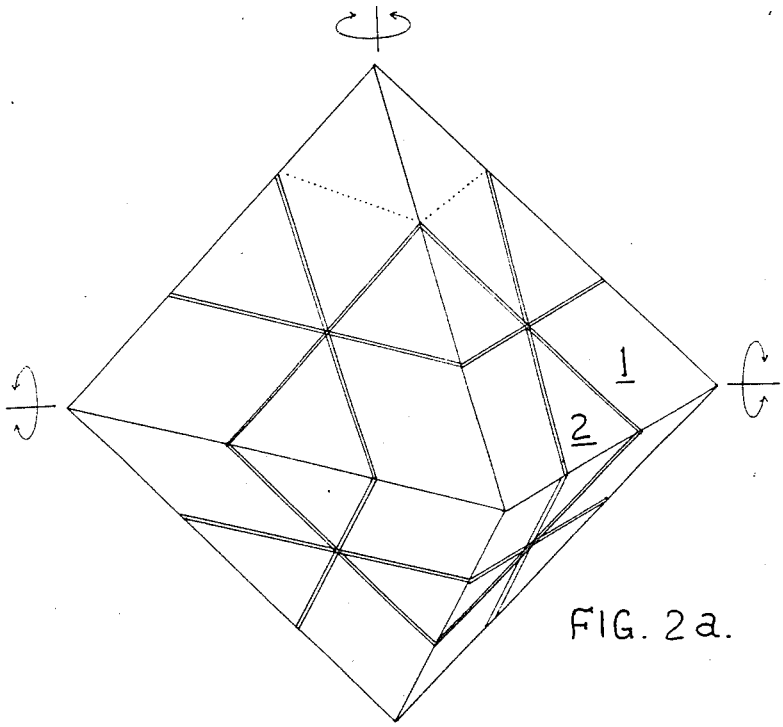
FIG. 2*a* is a perspective view showing four of the eight equilateral triangle faces and showing (double lines) basic subdivisions and showing a possible additional (dotted lines) subdivision of a corner component piece which can be implemented to all corner component pieces.
Figure 2B:
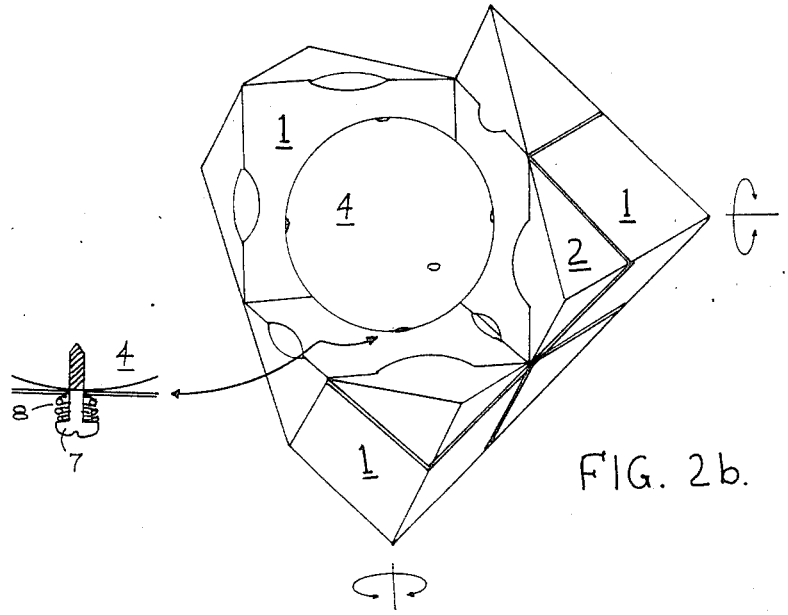
FIGS. 2*b–d* show perspective views of the puzzle when some of the external component pieces are removed. These figures show views of typical edge pieces 2 which are tetrahedrons extended by circular knobs, are held in place by these knobs in all possible puzzle configurations, and are allowed to migrate from edge to edge as a result of twists and turns. These figures also show views of typical corner component pieces 1 which are joined at the centers of their square bases to, and are restricted to rotate in place over, an appropriate central core part 4, 5 or 6. Such joining is as illustrated in the expanded views to the left of these figures by means of a screw 7 with a smooth top part surrounded and supported inside component pieces 1 by a spring 8; the screw 7 extending and being fixed to the central core part 4, 5 or 6.
Figure 2C:
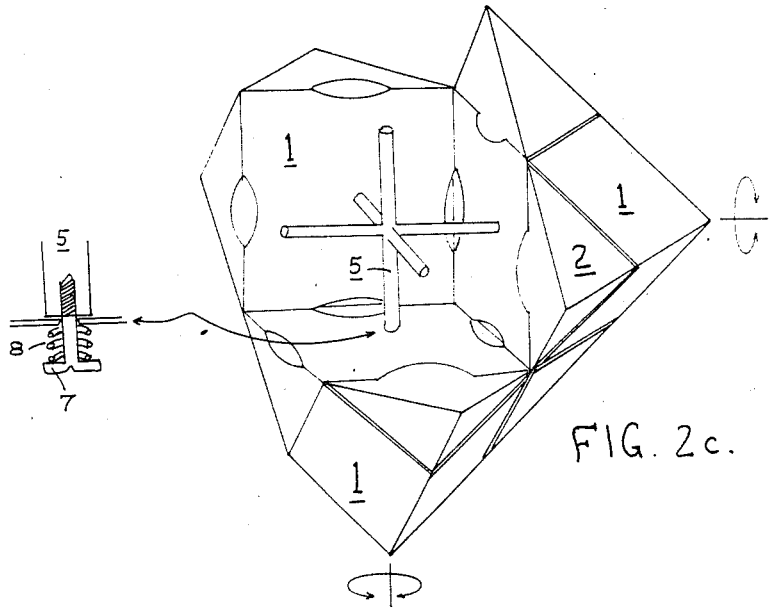

The typical corner component piece 1 of FIGS. 2*a–d* has four (4) exposed diamond faces which share a common vertex. The diamond has two 60 degree angles and two 120 degree angles, one of the 60 degree angles coincides with the angle of the corresponding equilateral triangular face of the octahedron. The corner component piece 1 has four unexposed predominantly triangular faces and a predominantly square base; each triangular face is uniquely defined by two edges of two adjacent external diamond faces, as is evident from a glance at FIGS. 2*a–d*. The square base of the corner component piece 1 of FIGS. 2*a–d* is adjoined at its center to either (i) one of six rod axes (pivots) which have the same form and orientation as the six rod axes (pivots) of the Rubik's 3×3×3 cube (a spring mechanism at the top of each rod axis inside a corner component piece 1 in FIG. 2*c* is desirable in this case); here each rod is orthogonal to a plane of rotation and extends between that plane of rotation and the center of the octahedron, the rods are fixed relative to each other, (ii) a center sphere with origin the center of the octahedron and with a surface tangent to all the planes of rotation, or (iii) one of the vertices of an internal central octahedron structure which is concentric with the external octahedron structure of the subject puzzle and which has faces parallel to the faces of the external octahedron structure. The edges of the square base of a corner component piece are modified by cutting out portions corresponding to partly spherical or cylindrical grooves, the centers of the spheres (the axes of the cylinders) of said grooves lie along (coincide with) axes of rotation of adjacent corner component pieces.

A knob is adjoined to the unexposed edge of each edge component piece 2 in such a way that in the assembled position, the knob would fit in the internal groove bounded by the modified unexposed surfaces of adjacent corner pieces. The knob has partly spherical or cylindrical surfaces and serves to prevent disassembly, but yet can move freely in circles in the internal groove as a result of twists and turns.

Figure 2D:
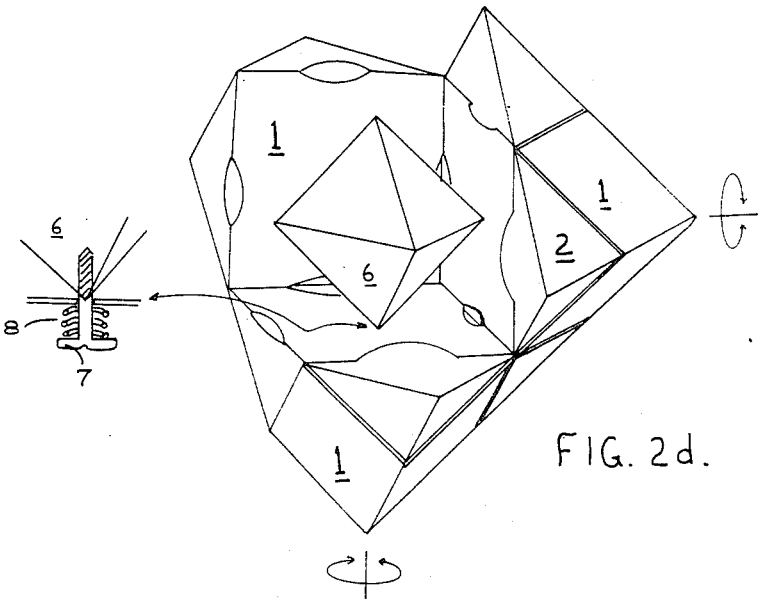

It may also be desirable for cosmetic reasons to cut each corner piece of the preferred embodiment of FIGS. 1 and 2 (see FIGS. 1*b* and 2*a*) in two, for example along the dotted or dashed lines in FIG. 2*a*, and to allow the resulting top square-based pyramid piece to rotate above the bottom piece in a manner similar to that shown in FIGS. 2*b–d* for joining corner component peices to the core central part of the puzzle. Again, ball bearings or combinations of hemi-spherical knobs and indentations at corresponding locations of adjacent faces of component pieces are desirable in order to enhance the structural stability of this puzzle.

For ease of reference, the octahedron puzzle of FIG. 1*a* will be labeled Rubik type Octahedron, and the puzzle of FIG. 2*a* will be labeled Pyraminx type Octahedron.

It is emphasized that for the Pyraminx type Octahedron, the advantage of an internal concentric octahedron of the correct size is that rotation occurs directly over the vertices of the internal structure. Such an arrangement could result in ease of manufacturing.

(C). Icosahedron Puzzle

Figure 3A:
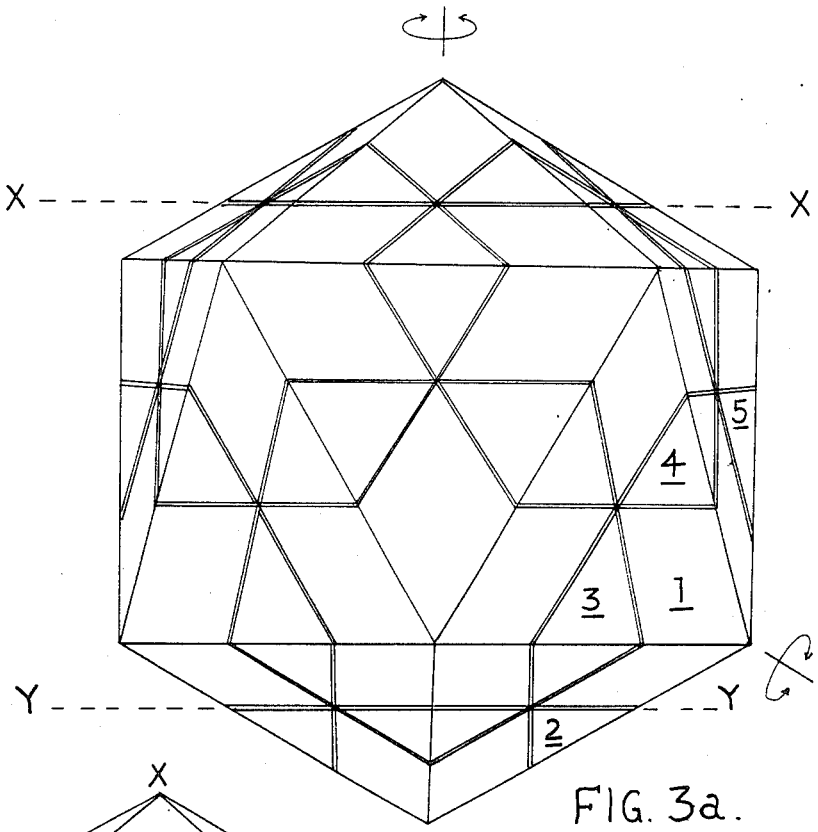
FIGS. 3*a,b* show views of an icosahedron puzzle of this inventin and its component pieces.
Figure 3B:
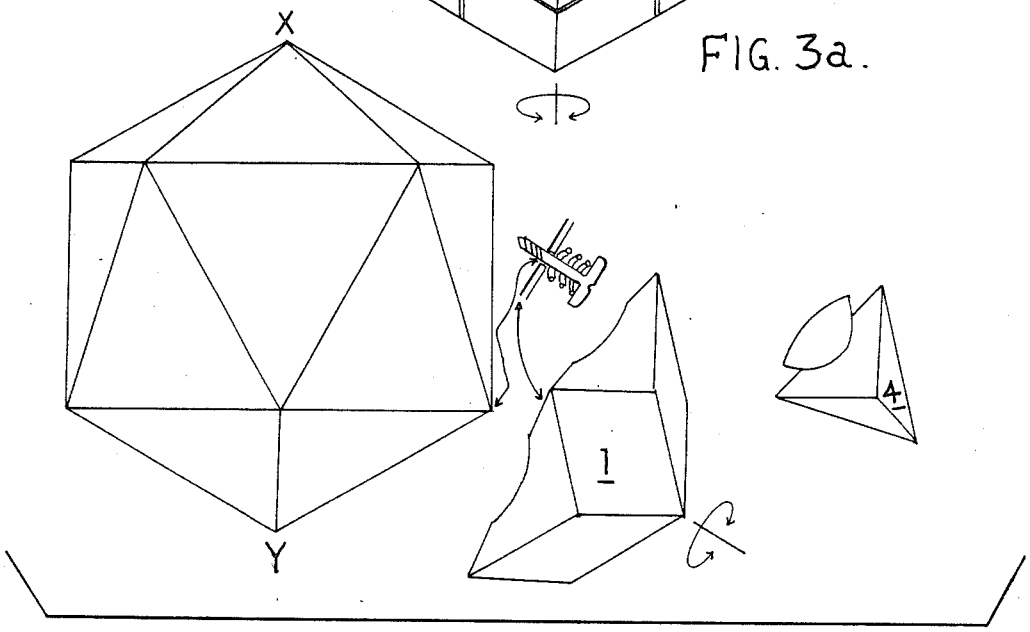
FIG. 3*b* shows a possible construction of the core central part of the puzzle being an internal concentric icosahedron. The distance between vertices marked X and Y in FIG. 3*b* is the same as the distance between the corresponding planes of rotation marked in FIG. 3*a*. Again the icosahedron of FIG. 3*b* can be replaced by a central sphere or by an axial system in a manner similar to that illustrated for the octahedron pouzzles of FIGS. 2*a–d* above.

A regular icosahedron is a solid with twenty plane triangular faces. FIG. 3*a* is a perspective view showing 10 of the 20 faces and showing by double lines borders of planes of rotation and subdivisions of corner 1 and edge 2, 3, 4, 5 component pieces of the preferred embodiment of the puzzle. FIG. 3*b* shows an icosahedron as a possible core central part and shows a corner structure 1 and a typical edge component structure 4. This figure also shows how the component structure 1 is joined to the core central part of the puzzle. The joining is analogous to that in the parent patent application and analogous to that in FIG. 2 and is by means of a screw (pivot) with a smooth top part surrounded by a spring lying in component piece 1; said screw further extends into and is fixed to the core central part as is indicated in FIG. 3*b*.

This puzzle can be visualized as also being formed as follows. Start with a solid regular icosahedron. Cut this solid regular icosahedron along distinct planes (planes of rotation), one plane orthogonal to each straight line joining a vertex and the geometric center of the icosahedron; said plane also passing through the five geometric centers of the triangular faces of the icosahedron which have that vertex as their common vertex. As a result, the solid icosahedron is subdivied into (a) corner component pieces, (b) edge component pieces, and (c) a core central part with no exposed faces. The core central part is to be replaced (in a manner similar to that shown for the puzzle of FIGS. 2*a–d*) by either (i) an inner sphere with origin the center of the icosahedron and with a surface tangent to all the planes of rotation, or (ii) an axial rod (pivot) system with each rod orthogonal to a plane of rotation and extending between that plane of rotation and the center of the icosahedron; the rods are fixed relative to each other and each rod is to have a spring around its top part inside a corner component piece, or, as in FIG. 3*b*, (iii) an internal concentric icosahedron may be used in place of an axial system to fix locations and allow for the possible rotations, twists and turns. Each corner component piece has a pentagon base, parts of each edge of the pentagon base are cut off along spherical or cylindrical surfaces as in FIG. 3*b* in such a way as to extend and form boundaries of the grooves in the core central part mentioned above. Each corner component piece is joined at the center of its pentagon base to the modified core central part of the icosahedron, and is restricted to rotate freely in place around the line passing through the center of its base and the center of the icosahedron. Each edge component piece, as 4 in FIG. 3*b*, is a tetrahedron with two exposed faces and two unexposed faces. A knob with partly spherical or cylindrical surfaces is adjoined to the unexposed edge of each tetrahedron edge component piece. Each knob fits in the grooves between the modified corner component piece. Each knob fits in the grooves between the modified corner component pieces and the modified core central part and serves to hold its associated edge component piece in place in the various possible orientations.

Each of the modified corner pieces and its adjacent five modified edge pieces can rotate together as a group over a plane of rotation. Ball bearings or combinations of small hemi-spherical knobs and grooves are desirable between the common faces of corner and edge component pieces in order to stabilize the rest positions and improve the robustness and structural integrity of the puzzle. While we have illustrated and described several embodiments of our invention, it will be understood that these are by way of illustration only and that additional changes, extensions and modifications may be contemplated in this invention within the scope of the following claims.

We claim:

1. In a geometrical puzzle comprised of a core central part and at least 18 component structures stacked together to form a regular polyhedron structure; said regular polyhedron structure having M edges, N vertices (corner points), and at least eight external plane faces;

each of M of said component structures is an edge structure having two exposed plane faces which meet along an edge of said regular polyhedron structure; each of N of said component structures is a corner structure having one vertex which coincides with a vertex of said regular polyhedron structure; the number of corner structures is the same as the number N of vertices of said regular polyhedron structure, the number of edge structures is the same as the number M of edges of said regular polyhedron structure;

each of the N corner structures is associated with a rod axis (pivot) and is joined to and is allowed to freely rotate in place around said rod axis (pivot); said rod axis (pivot) is one of N similar rod axes (pivots) emanating from the center of said puzzle and forming the core central part of said puzzle; each of said rod axes if fixed in position relative to the other rod axes and lies around a straight line which joins a vertex of said regular polyhedron structure and the geometric center of the puzzle;

each of the N corner structure is restricted to rotate in place, each of the remaining structures is a free component structure and has a knob which fits in a groove formed between other component structures and said core central part; said knob serves to prevent undesirable disassembly of the puzzle;

each of said corner structures can be rotated together with all its adjacent component structures as a group around its associated rod axis; rotations of component structures alter the relative positions and the initial external surface designs; the object and challenge of the puzzle is to perform additional rotations to move the component structures back to their initial positions and to other interesting positions.

2. A puzzle as recited in claim 1 wherein said regular polyhedron structure is an octahedron comprised of twenty six component structures and a core central part; said octahedron being subdivided along six planes of rotation equidistant from the geometric center of the puzzle and being such that each pair of planes of rotation is parallel to each other and is parallel to a plane between them passing through the center of and through four of the external vertices of said octahedron; each said pair of planes of rotation also being orthogonal to each of the remaining planes of rotation; furthermore, said planes of rotation subdivide each triangle face of said octahedron into seven (7) parts, including a center part which is an equilateral triangle whose sides are parallel to the sides of said triangle face;

each of six of said component structures is a corner structure having a total of nine faces, having four exposed diamond plane faces and one unexposed square face; said corner component structure being joined at the center of its square face to, and being allowed to rotate freely in place around a rod axis (pivot); said rod axis being orthogonal to a plane of rotation and being one of six rod axes which emanate from the center of said puzzle and form the main mounting means for said puzzle;

the remaining component structures comprise eight face-center and twelve edge structures; each of the face-center structures has an exposed equilateral triangle face; each of said edge structures has two external visible trapezoidal plane faces; each of said remaining component structures has a fixed knob which fits in a groove between other component structures and serves to prevent disassembly of said puzzle;

plural groups of component structures on either side of a plane of rotation are allowed to rotate jointly around the rod axis (pivot) orthogonal to said plane of rotation.

3. A puzzle as recited in claim 1 wherein said regular polyhedron structure is an octahedron subdivided along six planes of rotation into 18 component structures (6 corner structures and 12 edge structures); each plane of rotation is associated with a vertex of said regular polyhedron structure and passes through the the geometric centers of the four triangular faces which have that vertex in common.

4. A puzzle as recited in claim 1 wherein said regular polyhedron structure is an icosahedron subdivided into component structures along planes of rotation, one plane of rotation associated with each vertex and passing through the the geometric centers of the five triangular faces which have that vertex in common.

5. In a geometrical puzzle having an external regular polyhedron structure with at least eight plane faces and having a core internal regular polyhedron structure, the external and internal structures being in the form of similar concentric regular polyhedrons with parallel faces and with each vertex of said internal regular polyhedron structure lying on the straight line which joins the corresponding vertex of said external regular polyhedron structure to the geometric center of the puzzle; said puzzle also having a hollow section inside said external regular polyhedron structure;

said external regular polyhedron structure being further subdivided into component pieces along planes of rotation, one plane of rotation passing through each vertex of said core internal regular polyhedron structure and being orthogonal (perpendicular) to the straight line which passes through that vertex and through the center of the puzzle; the relative sizes of said concentric regular polyhedrons being such that each plane of rotation passing through a vertex of said core internal regular polyhedron structure passes through the geometric centers of all external faces of the puzzle which share in common the corresponding vertex of said external regular polyhedron structure;

said component pieces are either (i) corner component pieces, one corner component piece corresponding to each vertex of said external regular polyhedron structure, or (ii) external edge component pieces, one external edge component piece corresponding to each edge of said external regular polyhedron structure;

each corner component piece of said external regular polyhedron structure sits directly above and is joined to a vertex of said core internal polyhedron structure by means of a screw (pivot) having a smooth top part supported at its head and surrounded by a spring totally inside the corner component piece, the screw extends through the vertex of and is fixed to said core internal polyhedron structure; the screw is aligned such as to allow its associated corner component piece to rotate freely in place around the straight line which passes through that vertex and through the center of the puzzle;

each external edge component piece has the general shape of a tetrahedron with two exposed triangular faces and with a knob adjoined to its unexposed edge; said knob fits in a groove to prevent disassembly; parts of the edges of each corner component piece which lie along a plane of rotation are cut off to form parts of grooves to accommodate the knobs of edge component pieces;

each corner component piece and its adjacent edge component pieces are allowed to rotate together as a group above a plane of rotation around the straight line passing through the center of said puzzle and orthogonal to said plane of rotation; rotations of component structures alter the relative positions and the initial external surface designs; the object and challenge of the puzzle is to perform additional rotations to move the component structures back to their initial positions and to other interesting positions.

6. A puzzle as recited in claim 5 wherien said external regular polyhedron structure is an octahedron.

7. A puzzle as recited in claim 5 wherein said external regular polyhedron structure is an icosahedron.

8. In a geometrical puzzle having an external regular polyhedron structure with at least eight plane faces and having a core internal spherical structure; said puzzle also having a hollow section inside said external regular polyhedron structure;

said external regular polyhedron structure being further subdivided into corner and edge component pieces along planes of rotation, one plane of rotation associated with each vertex of said external regular polyhedron structure; said one plane of rotation passing through the point of intersection of the straight line joining its associated vertex to the center of the puzzle and of the surface of said core internal spherical structure, said one plane also being perpendicular to said straight line; the size of said core internal spherical structure being such that each plane of rotation associated with a vertex of said external regular polyhedron structure passes through the geometric centers of all the external faces of the puzzle which share that vertex in common;

each corner component piece of said external regular polyhedron sits directly above a plane of rotation and is joined to the core internal spherical structure by means of a screw pivot having a smooth top part, said screw pivot is supported at its head and surrounded by a spring inside the corner component piece, the screw extends through and is fixed to said core internal spherical structure at the point where said plane of rotation meets said core internal spherical structure; each screw pivot is aligned such that each corner component piece is allowed to rotate freely in place around a straight line which passes through a vertex and the center of the puzzle; each edge external component piece has the general shape of a tetrahedron with two exposed triangular faces and with a knob adjoined to its unexposed edge; said knob fits in a groove to prevent disassembly; parts of the edges of each corner component piece which lie along a plane of rotation are cut off to form parts of grooves to accommodate the knobs of edge component pieces;

each corner component piece and its adjacent edge component pieces are allowed to rotate together as a group above a plane of rotation around the straight line passing through the center of said puzzle and orhtogonal to said plane of rotation; rotations of component structures alter the relative positions and the initial external surface designs; the object and challenge of the puzzle is to perform additional rotations to move the component structures back to their initial positions and to other interesting positions.

9. A puzzle as recited in claim 8 wherein said external regular polyhedron structure is an octahedron.

10. A puzzle as recited in claim 8 wherein said external regular polyhedron structure is an icosahedron.

* * * * *